US005957878A

United States Patent [19]

Gilliam

[11] Patent Number: 5,957,878

[45] **Date of Patent: *Sep. 28, 1999**

[54] BODY SUPPORT GARMENTS

[76] Inventor: Phillip L. Gilliam, 5763 Edgepark Rd., Baltimore, Md. 21239

[ * ] Notice: This patent issued on a continued prosecution application filed under 37 CFR 1.53(d), and is subject to the twenty year patent term provisions of 35 U.S.C. 154(a)(2).

[21] Appl. No.: 08/755,493

[22] Filed: Nov. 22, 1996

[51] Int. Cl.[6] ..... A61F 13/00; A61L 15/00; A61B 19/08

[52] U.S. Cl. ..... 602/60; 602/77; 128/856

[58] Field of Search ..... 602/60–63, 77; 482/105, 124, 148; 128/856, 869, 873, 874

[56] References Cited

U.S. PATENT DOCUMENTS

| | | | |
|---|---|---|---|
| 2,723,396 | 11/1955 | Stack | 602/61 X |
| 2,829,641 | 4/1958 | Jobst . | |
| 3,279,465 | 10/1966 | Cherio et al. . | |
| 3,874,001 | 4/1975 | Patience et al. | 2/240 |
| 3,892,239 | 7/1975 | Masso Remiro | 602/63 X |
| 4,027,667 | 6/1977 | Swallow et al. . | |
| 4,065,814 | 1/1978 | Fox | 2/79 |
| 4,073,490 | 2/1978 | Feather | 482/129 |
| 4,084,586 | 4/1978 | Hettick . | |
| 4,121,582 | 10/1978 | Masso Remiro | 602/76 |
| 4,469,095 | 9/1984 | Herrera . | |
| 4,702,234 | 10/1987 | Huntjens | 602/65 |
| 4,784,128 | 11/1988 | Scheuermann . | |
| 4,999,845 | 3/1991 | Jenks, Jr. et al. | 2/2.1 R |
| 5,144,694 | 9/1992 | Conrad Daoud et al. | 482/105 |
| 5,171,211 | 12/1992 | Deasy, Jr. . | |
| 5,176,600 | 1/1993 | Wilkinson | 482/124 |
| 5,201,074 | 4/1993 | Dicker | 482/105 |
| 5,263,923 | 11/1993 | Fujimoto . | |
| 5,367,708 | 11/1994 | Fujimoto . | |
| 5,383,235 | 1/1995 | Peters . | |
| 5,403,271 | 4/1995 | Saunders et al. . | |
| 5,425,702 | 6/1995 | Carn et al. . | |
| 5,429,593 | 7/1995 | Matory . | |
| 5,497,513 | 3/1996 | Arabeyre et al. | 602/63 X |
| 5,582,583 | 12/1996 | Ballantyne | 602/5 |

OTHER PUBLICATIONS

Zimmer Product Encylopedia, p. G14.

*Primary Examiner*—Richard J. Apley
*Assistant Examiner*—Denise Pothier
*Attorney, Agent, or Firm*—Dinsmore & Shohl LLP

[57] ABSTRACT

A body support garment having a tubular elastic section for enclosing a body member is provided. The tubular section has an inner surface with a first portion and a second portion, the first portion providing a gripping surface and the second portion providing a predetermined circumferential strain ratio. The garments can be provided in the form of a pant or a vest.

20 Claims, 10 Drawing Sheets

BODY SUPPORT GARMENTS

FIELD OF THE INVENTION

This invention relates generally to the field of muscle support garments for the human body, and, more particularly, to injury accommodating garments for use by athletes which provide improved bodily support, impact absorption, and thermal properties for the protection of injured muscles and other tissues.

BACKGROUND OF THE INVENTION

Support garments have various constructions in the art. For instance, U.S. Pat. No. 5,383,235 to Peters discloses a shirt which is worn on the upper torso of an individual, preferably a weight-lifter. The upper portion of the shirt has a circumference which is substantially less than the chest circumference of the wearer while the lower portion has a circumference which is substantially the same as the waist circumference of the wearer. Peters alleges that when the shirt is zipped, there is significantly more pressure exerted by the garment across the chest portion of the wearer as the material of the shirt must stretch more at the upper chest portion of the shirt to close the distance than at the waist portion of the shirt. Peters contends that the extreme tightness of the shirt adds to the upward force required for lifting a weighted bar upwards and away from the chest, such as in a bench press.

While some support garments have been adapted to assist in athletic type activities, others have been adapted to provide support and/or protection of injured muscles. For instance, elastic bandages formed from a strip of elastic material which can be wrapped about a portion of the body and retained in place by metal clips or tape are one arrangement known in the art. Alternatively, tubular support members are illustrated, for example, in U.S. Pat. No. 4,084,586 to Hettick which discloses a support member having an outer facing bonded to the interior and exterior surfaces of an elastic material. The interior and exterior surfaces of the support member have relatively low coefficients of friction and the same stretch rate as the elastic material. Hettick theorizes that adequate but not excessive tightness can be made possible by the low coefficient of friction, the absolute memory of the support member, and the stretchability in all directions, whereby the body portion enclosed conforms to the tube rather than vice versa.

While the above-described devices may be suitable for the uses for which they were designed, there is a desire to provide body support garments having improved circumferential and longitudinal muscular and skeletal bodily support for athletes engaging in movement intensive sports (e.g., football, soccer, and the like). It would be further desirable to provide body support garments having improved impact absorption and thermal properties in combination with improved muscular and skeletal bodily support. Still further, it would be desirable to provide a body support garment having predetermined muscular and skeletal support, impact absorption, and thermal properties. These characteristics are especially useful where a body support garment is required to adequately protect injured muscles, bones, and tissues from further injury in movement intensive sports.

SUMMARY OF THE INVENTION

A body support garment is provided comprising a generally tubular elastic section for enclosing a body member. This section has an opening for receiving the body member and an inner surface having a first portion and a second portion. The first portion provides a gripping surface while the second portion provides a predetermined circumferential strain ratio. Preferably, the circumferential strain ratio is between about 0.02 and 0.14 and the coefficient of friction of the gripping surface is at least about 0.4. The garment can be provided in the form of a pant or a vest, wherein each has a sleeve for engaging a portion of the body. A garment of the present invention can be formed by adjusting the material thickness, elastic modulus, coefficient of friction, and the circumferential strain ratio to provide a predetermined amount of bodily support.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

DETAILED DESCRIPTION OF THE PREFERRED EMBODIMENTS

Figure 1:
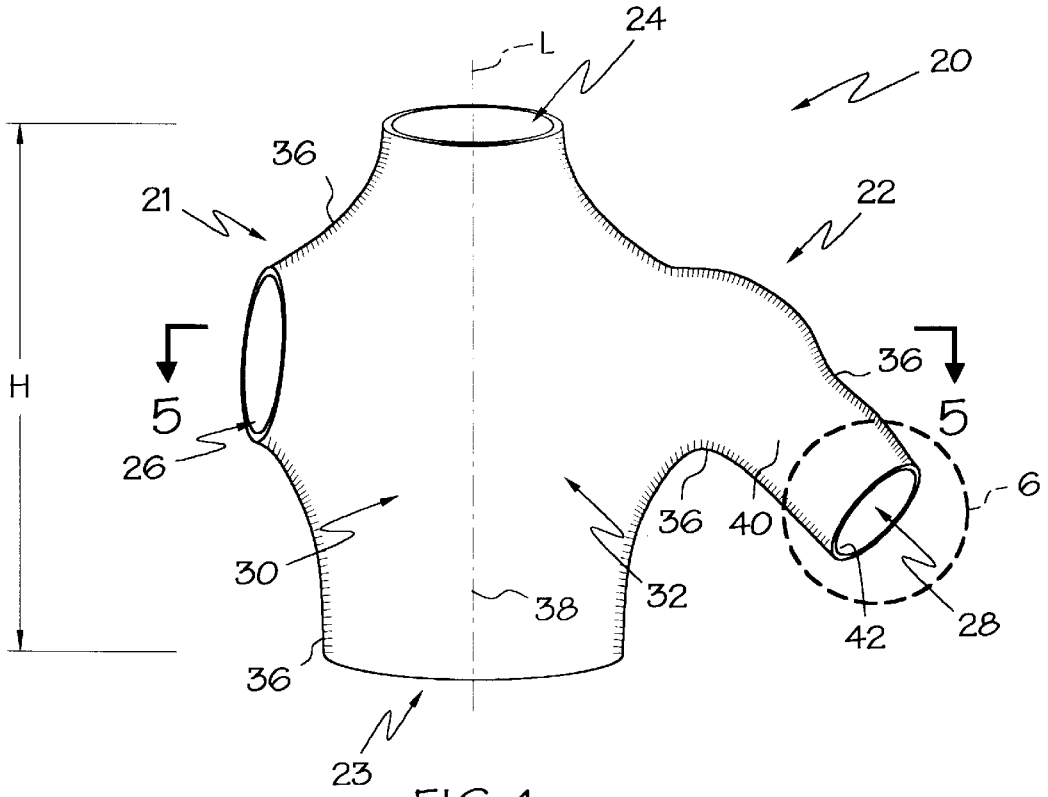
FIG. 1 is a perspective view of a preferred embodiment of a body support garment made in accordance with the present invention in the form of a vest having a left arm sleeve.
Figure 2:
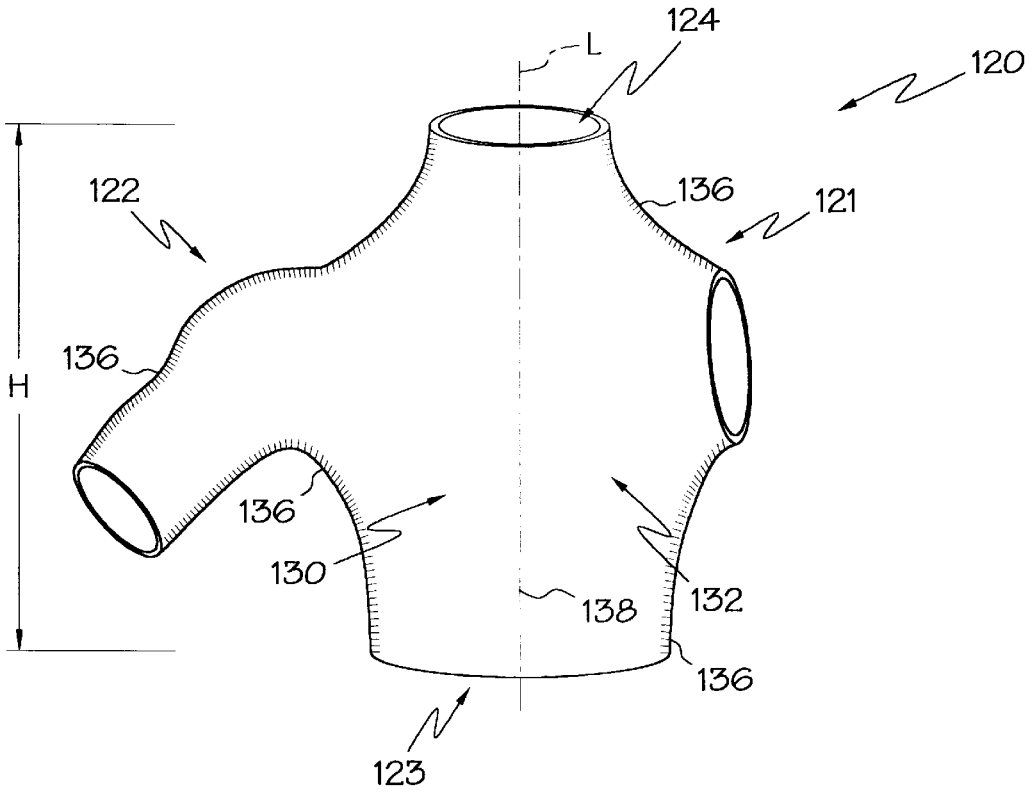
FIG. 2 is a perspective view of another preferred embodiment of a body support garment made in accordance with the present invention in the form of a vest having a right arm sleeve.
Figure 3:
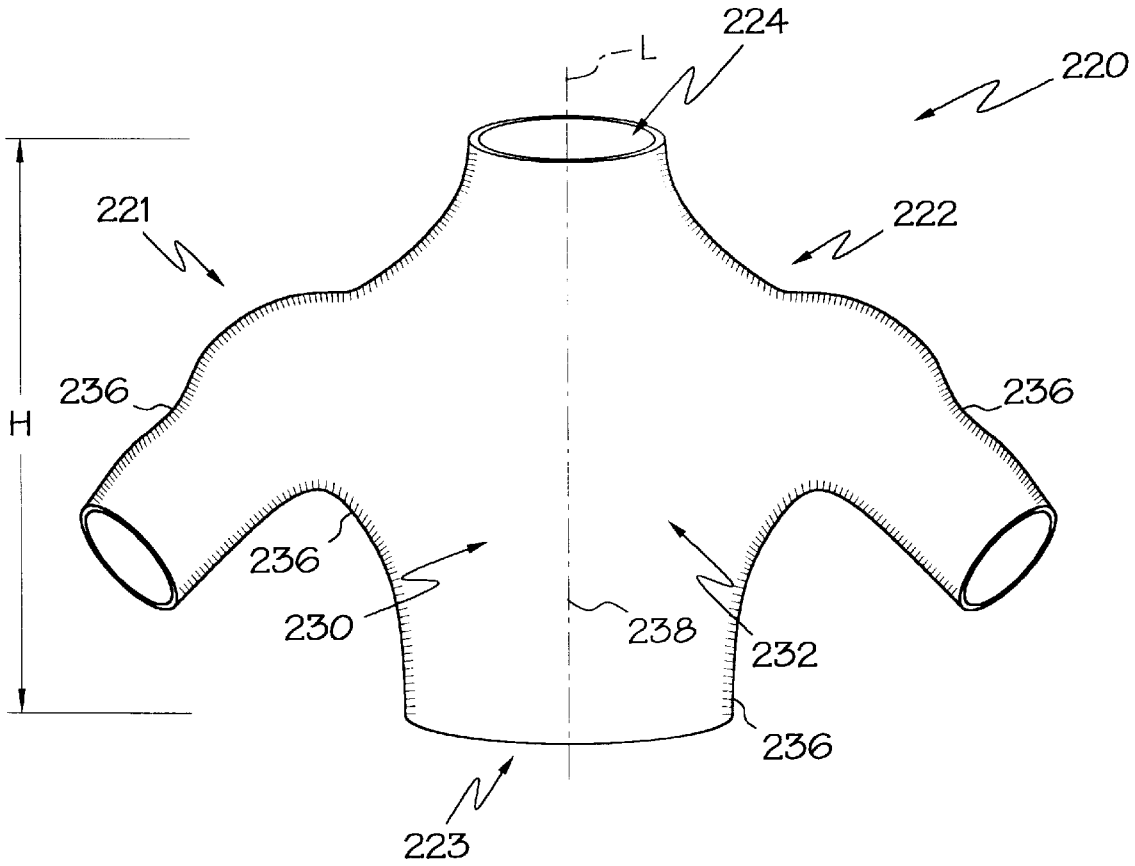
FIG. 3 is a perspective view of yet another preferred embodiment of a body support garment made in accordance with the present invention in the form of a vest having left and right arm sleeves.

Reference will now be made in detail to the presently preferred embodiments of the invention, examples of which are illustrated in the accompanying drawings wherein like numerals indicate the same elements throughout the views, and wherein numerals having the same last two digits (e.g., 20, 120, 220) connote corresponding parts or assemblies between various embodiments. As will be understood hereafter, the present invention relates to a body support garment which provides improved muscular and skeletal support, impact absorption, and thermal properties about an enclosed body portion. As used herein, the phrase "bodily support" (and its derivatives) refers to the resistance to bodily movement provided by a body support garment of the present invention. Referring now to FIGS. 1, 2 and 3, body support garments 20, 120, and 220 of the present invention are illustrated, each of which is particularly suited for supporting muscular and skeletal injuries to the shoulder and upper arms of its wearer. While the body support garments 20 and 120 are most suited for supporting injuries to the left and right shoulders, respectively, and the body support garment 220 is best suited for providing bodily support to both shoulders, each of these body support garments are similar in construction to the others and therefore only the body support garment 20 is discussed hereafter by way of example.

Figure 4:
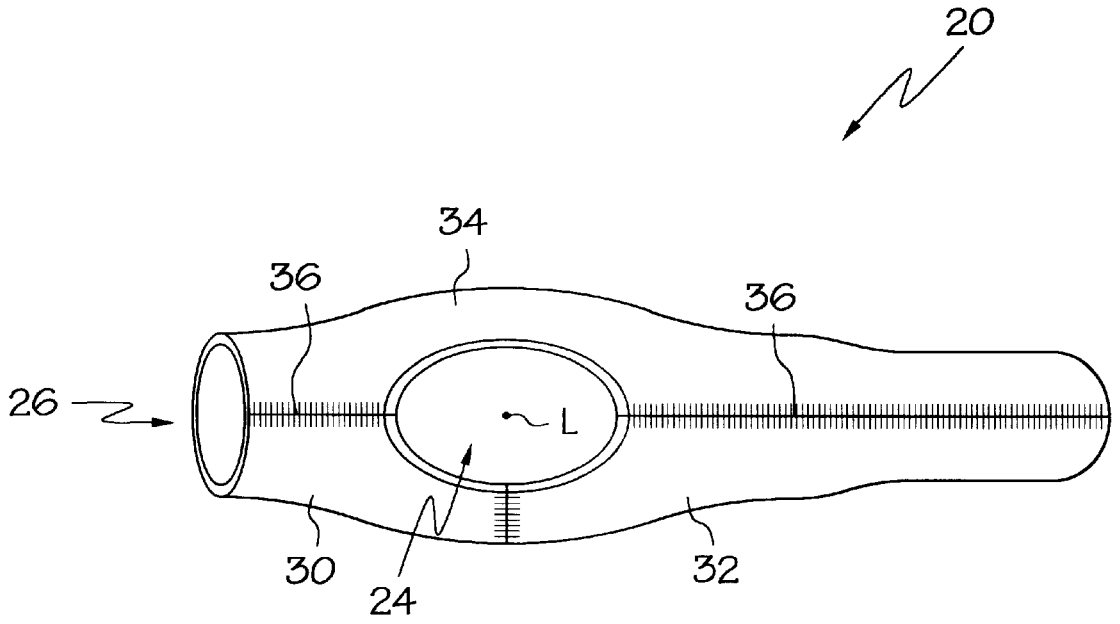
FIG. 4 is a top view of the body support garment of FIG. 1.

As shown in FIGS. 1 and 4, the body support garment 20 is in the shape of a vest having a generally tubular section 21 and a generally tubular arm sleeve 22. A longitudinal axis L generally extends coaxially from an abdominal opening 23 to a neck opening 24, the neck opening 24 and abdominal opening 23 being defined by a right front face 30, a left front face 32, and a rear face 34. The right front face 30 and left front face 32 are preferably releasably joined during use by a zipper 38 or other closure device such as hook and loop fasteners. Both front faces are also preferably joined to the rear face 34 by a stitched or bonded seam 36 which extends along the interface between rear face 34 and the front faces 30 and 32. This arrangement of the stitched seams 36 is desirable as the arrangement ensures that the stitched seams 36 will be subjected to mostly tensile and compressive forces during use in a direction parallel to the direction of the seam, thereby minimizing the tendency for separation of the stitched seams 36. A right shoulder opening 26 is disposed generally opposite a left arm opening 28, each opening being sized to accommodate its respective body member as described more fully hereafter.

The front and rear faces extend from the abdominal opening 23 upwardly and generally parallel to the longitudinal axis L to the neck opening 24. The right front face 30 and the left front face 32 extend generally from the zipper 38 in a direction transverse to the longitudinal axis L across to the right shoulder opening 26 and the left arm opening 28, respectively. The rear face 34 also extends in a direction generally transverse to the longitudinal axis L between the right shoulder opening 26 and the left arm opening 28. Thus, the front and rear faces are sized such that substantially all of the upper torso of a wearer and a selected portion of the left arm of the wearer to about the elbow can be enclosed by the body support garment 20. The body support garment 20 is preferably sized so that there are no gaps between a person wearing the garment and the inner surface of the garment. In addition, the body support garment 20 preferably has a height H such that the abdominal opening 23 is disposed adjacent the lowermost rib of the user. Alternatively, the height H can be increased such that the abdominal opening 23 is disposed below the lowermost rib, thereby providing improved bodily support to the abdominal area and lower back of a user. Such a body support garment of the present invention can further be provided in the form of a vest which does not have an arm sleeve 23, if it is desired to only provide bodily support to the torso of the user. While the above-described arrangement is preferred, it is contemplated that other arrangements may be equally suitable. For example, the body support garment 20 can comprise additional faces, seam arrangements, and structures for joining the right front face 30 and the left front face 32, or the arm sleeve of the body support garment 20 can be extended below the elbow if, for example, it is desired to provide improved bodily support to the elbow region.

Figure 5:
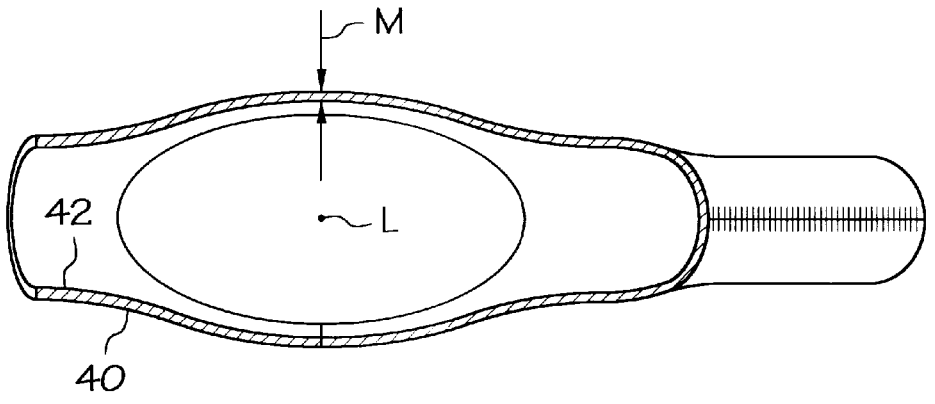
FIG. 5 is a partial cross-sectional view of the body support garment of FIG. 1, taken along line 5—5 thereof.

As most clearly seen in FIG. 5, the body support garment 20 is preferably formed from a substantially elastic material having an outer surface 40, an inner surface 42 and a material thickness M extending therebetween. More preferably, the body support garment 20 is formed from a closed cell polymer or rubber, such as neoprene or the like. Such a material is available from Rubatex Corporation of Roanoke, Va. under the designation R-1400-N. The bodily support provided by a garment of the present invention can be more particularly described as circumferential bodily support $F_C$ and longitudinal bodily support $F_L$. Preferably, a body support garment of the present invention is sized to provide circumferential bodily support $F_C$ and longitudinal body support $F_L$ when a user is in motion and only circumferential bodily support $F_C$ when a user is at rest. The circumferential bodily support $F_C$ resists expansion and contraction of muscles and aids in maintaining muscle position and alignment while longitudinal bodily support $F_L$ resists rotational movement of muscles and limbs when a user of the present invention is in motion. In addition, the circumferential bodily support $F_C$ can also influence the amount of longitudinal bodily support $F_L$ provided by the present invention, as described more fully hereafter. The amount of circumferential bodily support $F_C$ provided by a body support garment of the present invention can be characterized as a function of and generally proportional to the circumferential strain ratio $R_C$, the material thickness M, and the elastic modulus E of the material, as generally illustrated by equation (1) below:

$$F_C = f(R_C, M, E) \tag{1}$$

Where $F_C$ = the amount of circumferential bodily supportive provided;

$R_C$ = the circumferential strain ratio;

$M$ = the material thickness;

$E$ = the elastic modulus of the material.

Further, the circumferential strain ratio $R_C$ can be characterized by equation (2) below:

$$R_C = \frac{C_W - C_B}{C_W} \tag{2}$$

Where: $C_B$ = The circumferential length of the inner surface of a body support garment of the present invention about a predetermined body location;

$C_W$ = The circumferential length of wearer of a body support garment generally about the predetermined body location of $C_B$.

As used herein, the material thickness M and elastic modulus E refer to overall material properties of the material forming a body support garment, including the effects of any outer or inner surfaces. It is also believed that the longitudinal bodily support $F_L$ provided by a body support garment of the present invention is a function, in part, of the angle of rotation θ between a first and second position of a body support garment, as shown by way of example by the phantom lines in FIG. 1, and the coefficient of friction $\mu_1$ of the inner surface, as discussed more fully hereafter.

Figure 6:
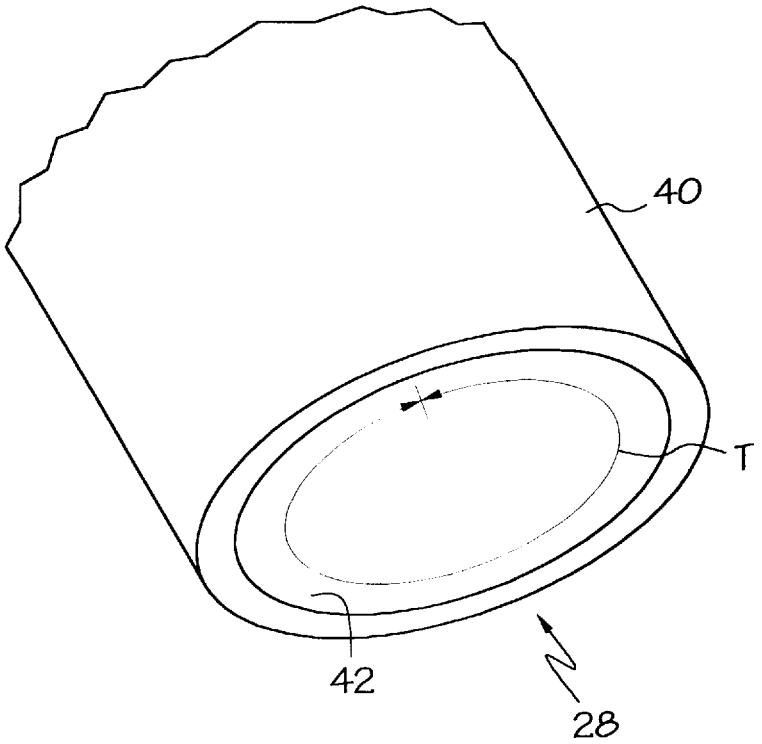
FIG. 6 is a partial perspective view of the left arm opening of the body support garment of FIG. 1, taken about circle 6 thereof.

The circumferential strain ratio $R_C$ is intended to be indicator of the amount of strain experienced by a body support garment of the present invention during use. For example, if the circumferential length $C_B$ of a body support garment about a predetermined location (e.g., the length of line T about the inner surface 42 of the left arm opening 28 of the body support garment 20, as shown in FIG. 6) is 35 inches and the circumferential length $C_W$ of a wearer of the body support garment at the same predetermined location is 40 inches, the circumferential strain ratio $R_C$ would be 0.125. Because a body support garment of the present invention is preferably sized to provide a circumferential strain ratio $R_C$ when worn, it preferably conforms to the shape and contour of its user. In order to provide effective bodily support of injured muscles, tissues, bones, and the like, it is preferred that the circumferential strain ratio $R_C$ is at least about 0.02, and, more preferably, between about 0.02 and about 0.14. Most preferably, the circumferential strain ratio $R_C$ is between about 0.05 and about 0.14. As will be apparent, the circumferential bodily support $F_C$ provided by a body support garment increases as the circumferential strain ratio $R_C$ increases. As discussed more fully hereafter, the circumferential strain ratio $R_C$ can be varied, in combination with the material thickness M and the elastic modulus E of the material as generally illustrated by equation (1), to achieve varying amounts of circumferential bodily support $F_C$. Preferably, a body support garment of the present invention does not provide longitudinal bodily support $F_L$ when a user of the garment is at rest, but, rather, the amount of longitudinal bodily support $F_L$ provided will necessarily depend, in part, upon the amount of limb rotation undertaken by a particular user of the invention.

With respect to body support garments in the form of vests, such as body support garment 20, it is preferred that the highest value for the circumferential strain ratio $R_C$ is provided adjacent the injured body member (e.g., a left or right shoulder). More preferably, the lowest value for the circumferential strain ratio $R_C$ is provided adjacent the chest to accommodate the rapid and extended breathing associated with strenuous and sustained athletic activity, a lower circumferential strain ratio $R_C$ resulting in less bodily support or resistance to movement. Most preferably, the circumferential strain ratio $R_C$ about the abdominal opening 23, right shoulder opening 26, and left arm opening 28 of the body support garment 20 is at least about 0.06, such that the body support garment is adequately anchored about the enclosed body member thereby providing improved longitudinal bodily support $F_L$, as discussed more fully hereafter.

In addition to the circumferential strain ratio $R_C$, the thickness M and elastic modulus E of the material of a body support garment of the present invention can also affect the amount of circumferential bodily support $F_C$ provided. In particular, the amount of circumferential bodily support increases as the elastic modulus E and material thickness M increase, as generally illustrated by equation (1) above. Preferably, the thickness M is at least about 0.1 inch, and, more preferably, between about 0.1 and about 0.25 inches, while the elastic modulus E is preferably at least about 5 psi, and, more preferably, between about 5 and about 35 psi. Most preferably, the elastic modulus E is about 20 psi.

The material thickness M also influences the impact absorbing and heat transfer properties of the present invention. As the material thickness M increases, the impact absorbing capability of a body support garment also increases such that more impact energy can be absorbed by the garment and less transmitted to its user, thereby reducing the risk of further aggravating existing muscular and skeletal injuries. The material thickness M inversely affects the garment's heat transfer properties such that an increase in the material thickness M will decrease the amount of heat transferred away from a user of a body support garment of the present invention. Retention of heat about an injured body member can advantageously reduce the risk of further injury where expansion and contraction of cold muscles and tendons is problematic. Conversely, it might be desirable to increase the heat transfer rate away from a body member by decreasing the material thickness M, such as at portions of the body where heat generation is high (e.g., the upper torso) and rapid heat transfer could prevent overheating and dehydration.

The thermal properties of the present invention can be influenced not only by the material thickness M, but also by the thermal conductivity K of the material. To minimize the amount of heat transferred to the environment, a low thermal conductivity K is desirable. Particularly, a material of the present invention preferably has a thermal conductivity K of less than about 0.30 (BTU*in)/(hr *ft$^2$*F.°), per ASTM Test Method C-518. While it is preferred that the thermal conductivity K is within the above-described ranges, it is contemplated that the thermal conductivity K can be adjusted in combination with the material thickness M to achieve a predetermined heat transfer property, as both variables can affect the heat transfer properties of the present invention.

While it is desirable that material thickness M, circumferential strain ratio $R_C$, and the elastic modulus E are within the previously described preferred ranges, it is contemplated that the same can be varied individually or in combination to provide a body support garment of the present invention with predetermined circumferential and longitudinal bodily support $F_C$ and $F_L$, impact absorption, and heat transfer properties, as required. Further, while it is preferred that the material thickness M and the elastic modulus E are relatively constant over any one body support garment of the present invention, it is further contemplated that the same can be varied over a single body support garment to vary the amount of bodily support, impact absorption, and heat transfer properties of different portions of a garment, as desired.

For example, a portion of a body support garment about an injured shoulder can be provided with a relatively high material thickness M and circumferential strain ratio $R_C$ to provide increased circumferential bodily support $F_C$ and a low heat transfer rate in comparison to another portion of the garment enclosing, for instance, the upper torso of the body. The relatively lower circumferential strain ratio $R_C$ and/or material thickness M provides less circumferential bodily support or resistance to expansion of the chest, thereby accommodating the rapid and sustained heavy breathing encountered during the exertion of athletic competition.

Alternatively, the present invention can provide distinct embodiments having the same circumferential bodily support $F_C$ but different impact absorption capabilities by adjusting the material thickness M in combination with the circumferential strain ratio $R_C$. For instance, a relatively thinner body support garment of the present invention can be provided by decreasing the material thickness M and increasing the circumferential strain ratio $R_C$ so as to provide the same bodily support as a garment having a relatively lower circumferential strain ratio $R_C$ and relatively greater material thickness M. While both garments may provide roughly the same circumferential bodily support $F_C$ for injured muscles and tissues, the former garment is lighter and less expensive to manufacture because less material is required while the latter garment is heavier but provides increased impact absorption capability, thereby decreasing the risk of further injury to a body member which could be highly susceptible to impact (e.g., a shoulder or upper arm). Thus, it should be readily apparent that body support garments of the present invention can be adapted to provide predetermined and widely varying amounts of circumferential and/or longitudinal bodily support, impact absorption, and thermal properties, depending upon the requirements of its user.

Referring now to FIG. 6, the inner surface 42 of the body support garment 20 preferably provides a gripping surface, wherein the gripping surface provides a coefficient of friction $\mu_1$ which is sufficient to prevent slip between the inner surface and the enclosed body member during use of the garment. More preferably, the inner surface 42 provides a coefficient of friction $\mu_1$ of at least about 0.4, and more preferably between about 0.4 and about 1.0, and, most preferably, about 0.5 when measured using a standard pull test per ASTM Test Procedure D4521-91 with an uncoated piece of stainless steel having a 28 $\mu$in. surface finish. A body support garment having an inner surface 42 with a relatively high coefficient of friction $\mu$ conforms to the contours of the wearer without "slipping" during use, thereby providing improved distribution of longitudinal bodily support $F_L$. While not intending to bound by any theory, it is believed that an inner surface 42 providing a relatively low coefficient of friction $\mu_1$ can permit relative "slip" between the body support garment and a rotating body member (e.g., the upper arm rotating about the shoulder), such that the body support garment can realign during physical exertion, thereby reducing the amount of strain experienced by the body support garment and, hence, reducing also the amount of longitudinal bodily support $F_L$ provided. However, it is believed that a high coefficient of friction $\mu_1$, singularly or in combination with a circumferential strain ratio $R_C$ about the garment openings (e.g., abdominal opening, left arm opening, etc.) which is within the numeric ranges described herein, can prevent realignment of the body support garment during physical exertion, thereby improving the amount of longitudinal bodily support $F_L$ provided.

The inner surface 42 can be provided with a raised texture, such as inner surface ridges and valleys or the like, to further increase the coefficient of friction $\mu_1$. Such a textured surface advantageously increases the coefficient of friction $\mu_1$ because the skin of an enclosed body member and the inner surface 42 are integrally contacted as the textured ridges press into the skin from the circumferential bodily support $F_C$ provided by a body support garment. While it is preferred that the inner surface 42 provides a uniform coefficient of friction $\mu_1$, it is contemplated that the coefficient of friction $\mu_1$ can vary over the inner surface 42. For example, a low coefficient of friction $\mu_1$ can be provided in portions of a body support garment where less longitudinal bodily $F_L$ support is required and where a low coefficient of friction $\mu_1$ could facilitate ease of removal of the body support garment. Variations in the coefficient of friction $\mu_1$ can also be accomplished by varying the coating and/or texture of inner surface 42, as is known in the art. Alternatively, the amount of longitudinal bodily support $F_L$ about a body member can be increased by increasing the circumferential bodily support $F_C$ while holding the coefficient of friction $\mu_1$ constant.

In contrast to the high coefficient of friction $\mu_1$ of the inner surface 42, the outer surface 40 of the body support garment 20 preferably has a relatively lower coefficient of friction $\mu_2$ so that other garments or protective structures (e.g., football shoulder pads etc.), can be easily worn over the body support garment 20 without restricting movement of the wearer. The low coefficient of friction $\mu_1$ can be provided by a nylon facing, or the like, attached to the outer surface 40, as is known in the art.

Figure 7:
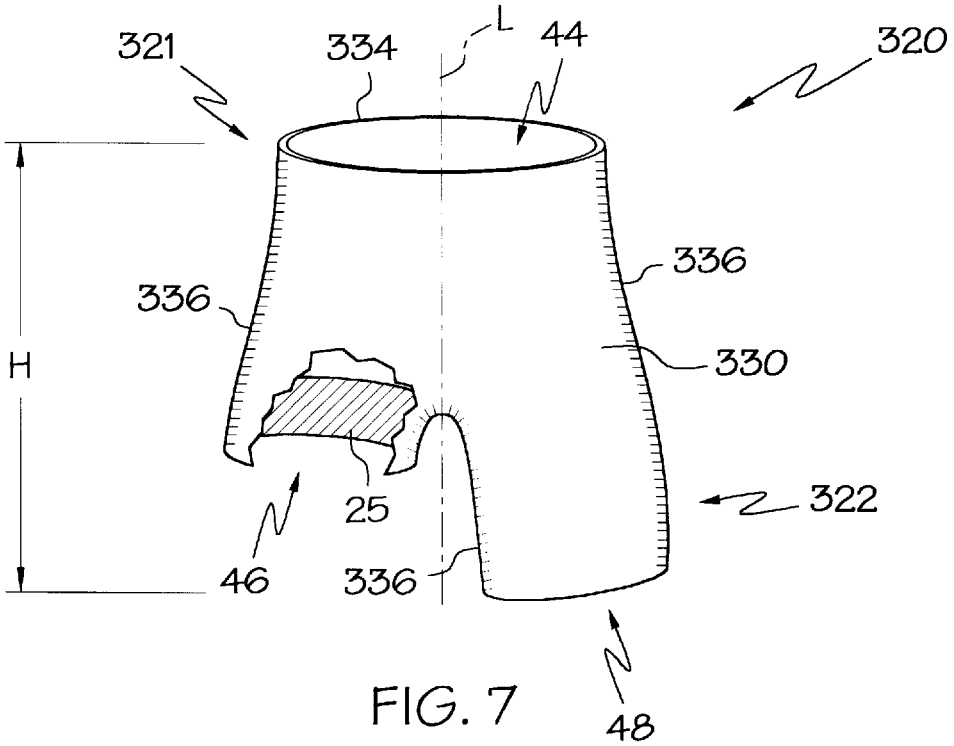
FIG. 7 is a perspective view of a preferred embodiment of a body support garment made in accordance with the present invention in the form of a pant having a left leg sleeve, wherein a portion of the pant has been removed to better illustrate certain structural details.
Figure 8:
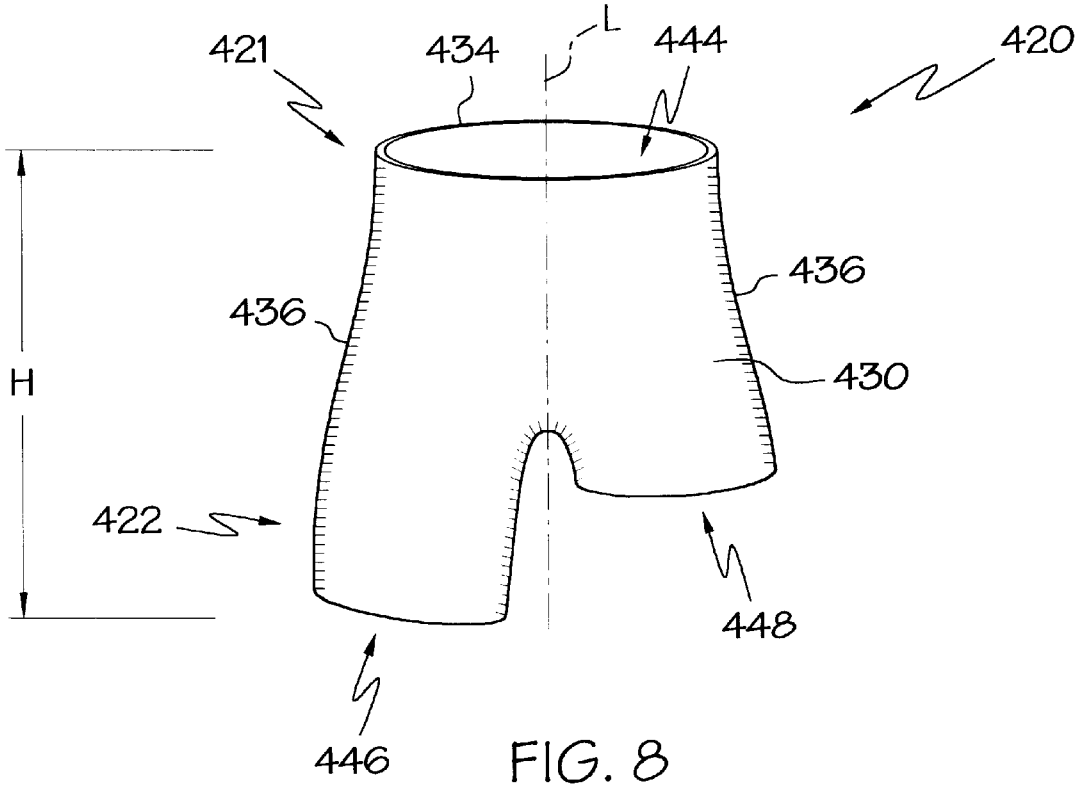
FIG. 8 is a perspective view of a body support garment made in accordance with the present invention in the form of a pant having a right leg sleeve.
Figure 9:
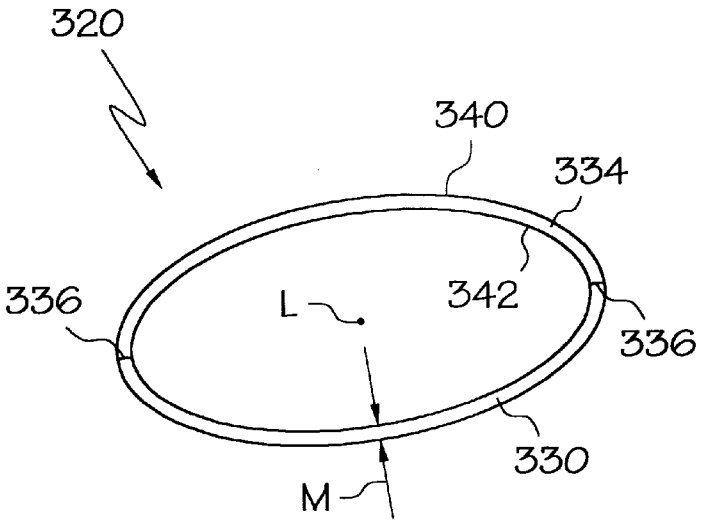
FIG. 9 is a top view of the body support garment of FIG. 7.

FIGS. 7 and 8 illustrate additional preferred embodiments of the present invention in the form of pants which are suitable for providing bodily support to the hamstring muscles of the left or right legs. The body support garment 320 is most suited for bodily supporting muscular injuries to the left leg while the body support garment 420 is best suited for providing bodily support to a right leg. Because body support garments 320 and 420 are similar in construction, only the body support garment 320 is discussed hereafter by way of example. As shown in FIGS. 7 and 9, body support garment 320 has a generally tubular lower torso section 321 with a waist opening 44 disposed substantially coaxial with a longitudinal axis L. A left leg opening 48 and a right leg opening 46 are disposed on either side of the longitudinal axis L. The height H of the body garment 320 is preferably sufficient so that the right leg opening 46 is adjacent the right knee of a user while the waist opening 44 is disposed adjacent the user's waist. The left leg opening 48 is preferably disposed just below the left hip of the user, as appropriate, to provide unrestricted movement of the left leg. The body support garment 320 is preferably formed from a front face 330 and rear face 334 which are joined by a stitched seam 336 at the interface between the faces, the faces defining the waist opening 44, the left leg opening 48, and the right leg opening 46. The body support garment 320 preferably has an outer surface 340 and inner surface 342 with coefficients of friction $\mu_1$ and $\mu_2$ as previously described.

While the circumferential bodily support $F_c$ provided by the body garment 320 can be varied by adjusting the circumferential strain ratio $R_C$, material thickness M, and elastic modulus E of the body support garment 320 as previously described, it is preferred that the highest circumferential strain ratio $R_C$ is provided at the leg openings 46 and 48 and the waist opening 44 so that the body support garment 220 can resist realignment during physical movement by the user. In other words, the high circumferential strain ratio $R_C$ in combination with an inner surface 342 having a high coefficient of friction $\mu$ preferably anchor the body support garment 320 so that improved longitudinal bodily support $F_L$ is provided. An exemplary portion 25 of the inner surface adjacent the opening 46 having a circumferential strain ratio and gripping surface is illustrated in FIG. 7 by way of example. More preferably, the body support 320, as well as other body support garments in the form of pants, preferably have a material thickness M which is less than the material thickness M of body support garments which are in the form of vests, as for example, with respect to the body support garment 20. The body support garments of the present invention in the form of vests preferably have an increased material thickness M because the upper torso of an athlete is more likely to experience higher impact forces than the lower torso and the increased material thickness M provides greater impact absorption capability.

Figure 10:
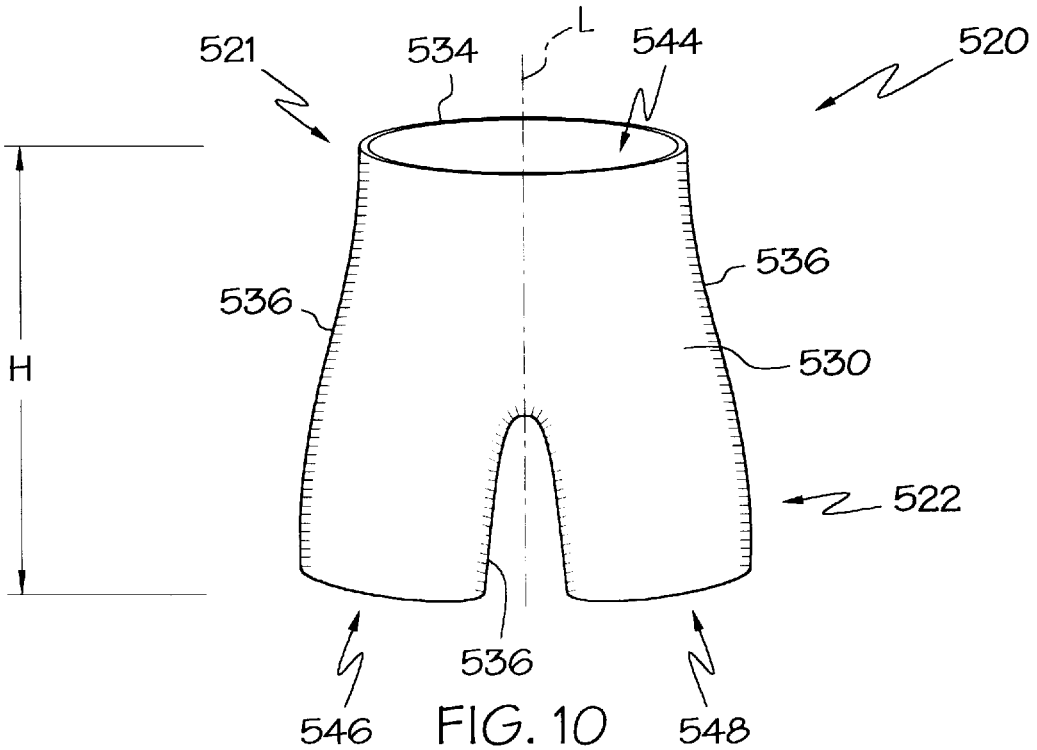
FIG. 10 is a perspective view of a body support garment made in accordance with the present invention in the form of a waist high pant having left and right leg sleeves.

FIG. 10 illustrates body support garment 520 of the present invention which is best suited for providing bodily support for both hamstring and groin muscles. The body support garment 520 is similar in form to the body support garment 320 and 420 previously discussed with the exception that both the right and left legs are enclosed by leg sleeve to adjacent the knee. Enclosing both the right and left legs advantageously supports the muscles of the groin, which are disposed in the region about the thigh and the trunk of the body. While the height H of the body support garment 520 is preferably such that the waist opening 44 is adjacent the waist of the user and the leg opening 48 is adjacent the knee, it is contemplated that the height H can be increased so that the waist opening 44 is disposed above the user's waist. This increase in the height H can provide additional bodily support to the lower back and abdomen of the user.

A garment of the present invention can be made by first determining the circumferential lengths of a body member of a wearer of the garment. For instance, the circumferential length about a shoulder, a bicep muscle, and the elbow can be useful in providing a garment of the present invention which bodily supports an injured shoulder or upper arm. The material thickness, elastic modulus, strain ratio $R_C$, coefficient of friction $\mu_1$, and thermal conductivity K can then be selected so that the garment will provide the desired circumferential and longitudinal bodily support, impact absorption, and heat transfer properties about the enclosed body member. After determining the strain ratio $R_C$ and knowing the circumferential lengths of the wearer, a dimensional template can be formed which is used to size the front and rear faces of the garment. After cutting the material according to the dimensions of the template, the front and rear faces can be bonded and/or sewn at their periphery, as is known in the art.

The present invention will be further illustrated by the discussion of the body support garments of FIGS. 11 to 18. FIGS. 11 to 18 illustrate preferred body support garments of the present invention which are suitable for providing bodily support and impact absorption capabilities to various portions of a user's body and/or arms. FIGS. 11 to 14 are in the form of a vest while providing support to the upper torso of a user while FIGS. 15 to 18 are in the form of a pant best suited for providing support to the hamstring and/or groin muscles of a user. Most particularly, each of the body support garments is manufactured from a closed cell neoprene rubber provided by Rubatex of Roanoke, Va. under the designation of R-1400-N having an elastic modulus E of about 20 psi and a thermal conductivity K of about 0.30 (BTU*in)/(hr *ft$^2$*F.°). The inner surface of each of the garments has a coefficient of friction of about 0.5 while the outer surface has a relatively lower value. The material thickness M of the body support garments illustrated in FIGS. 11 to 14 is about 0.25 inch while the body support garments of FIGS. 15 to 18 has a material thickness M of about 0.18. Each of the above-described body garments provides improved bodily support, impact absorption, and thermal properties.

Table 1 summarizes the circumferential strain ratios $R_C$ for the body support garments of FIGS. 11 to 18, wherein the circumferential strain ratio $R_C$ is based upon the circumference of the inner surface of the material about a predetermined point and the circumference of a user about the same point. Each of the points about which the circumferential strain ratio $R_C$ was measured is generally shown in FIGS. 11 to 18.

Figure 11:
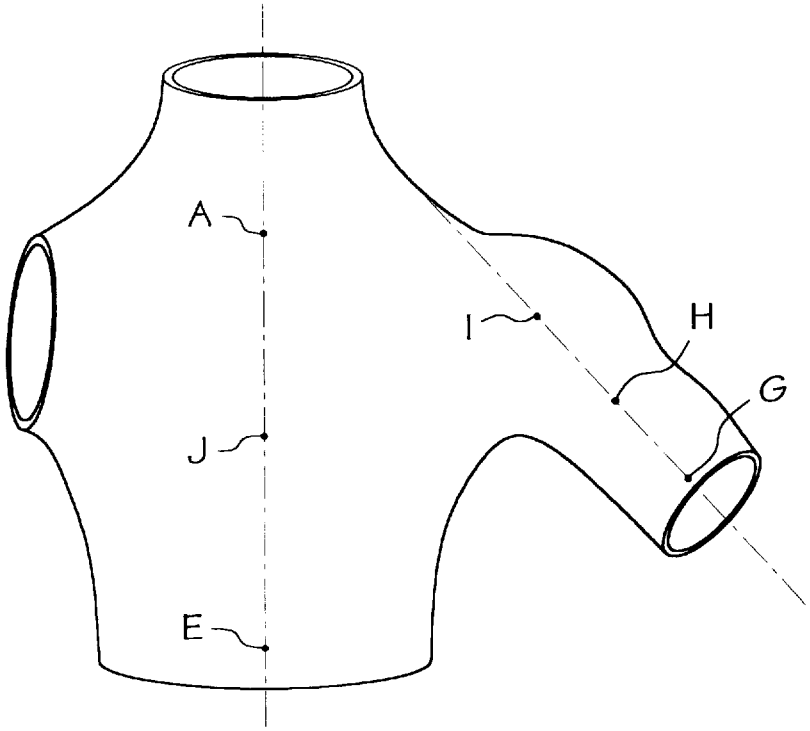
FIGS. 11 to 18 illustrate various embodiments of body support garments of the present invention, wherein points are illustrated about which a circumferential strain ratio $R_c$ is measured.
Figure 12:
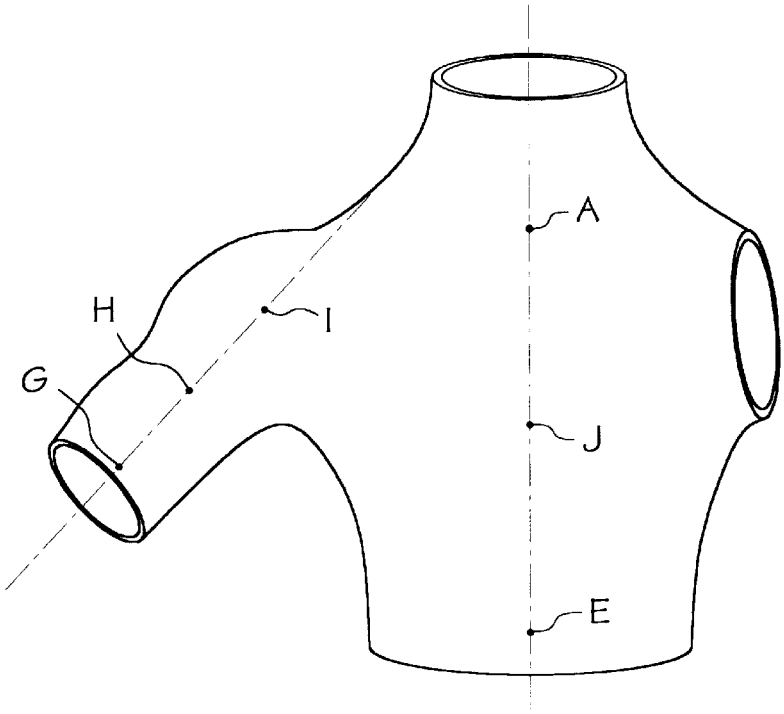
Figure 13:
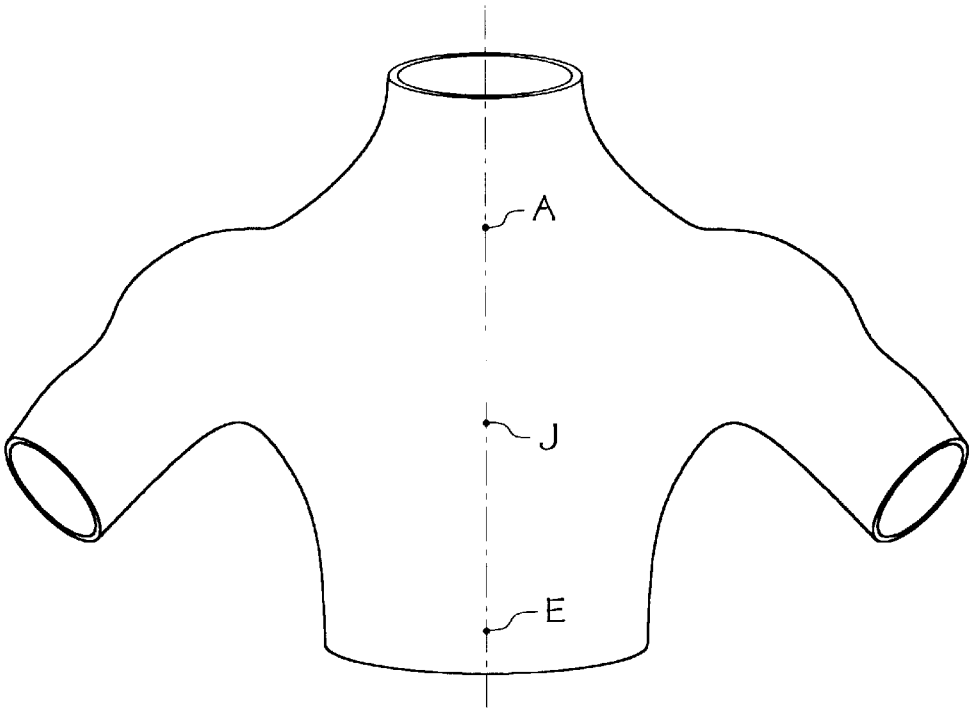
Figure 14:
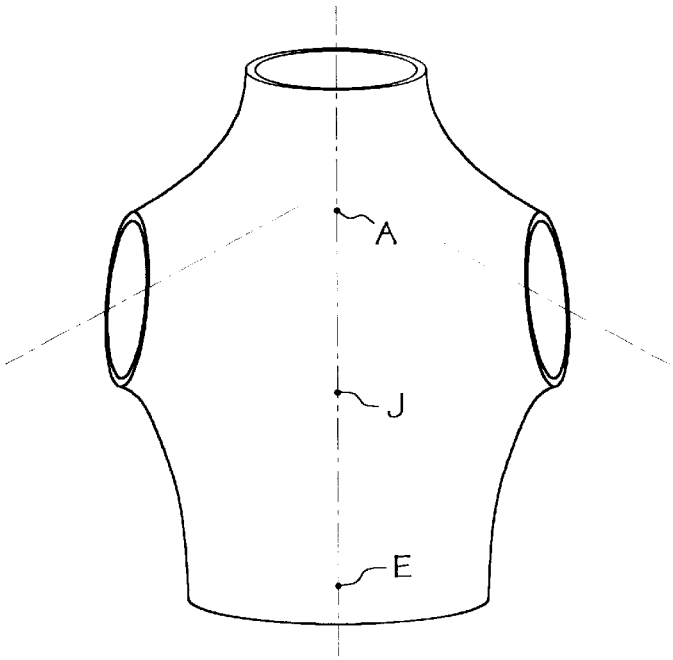
Figure 15:
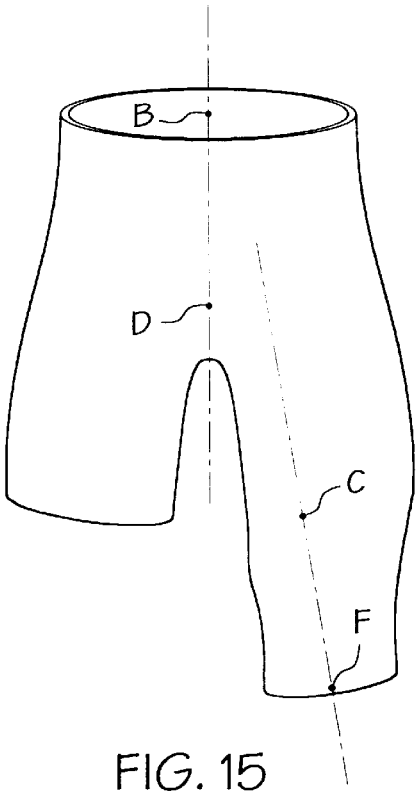
Figure 16:
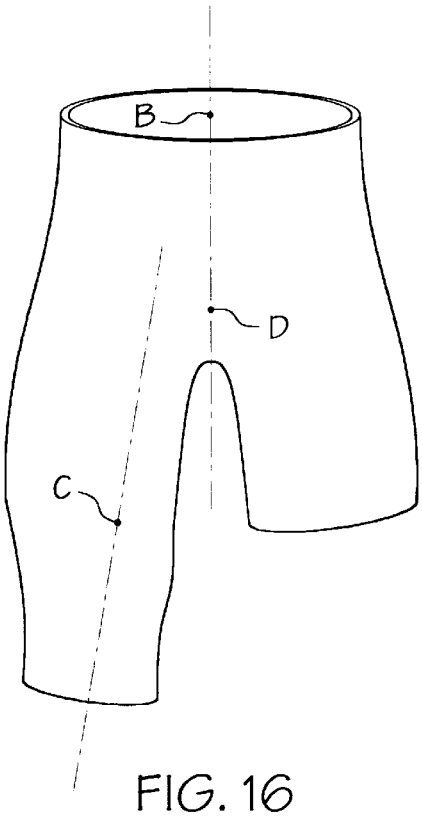
Figure 17:
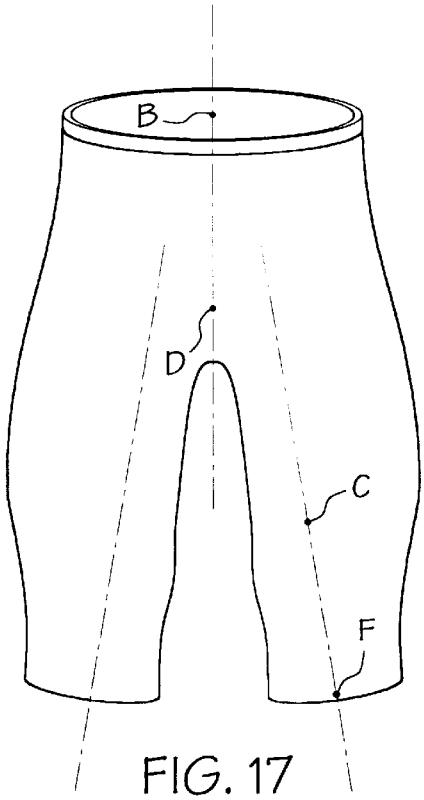
Figure 18:
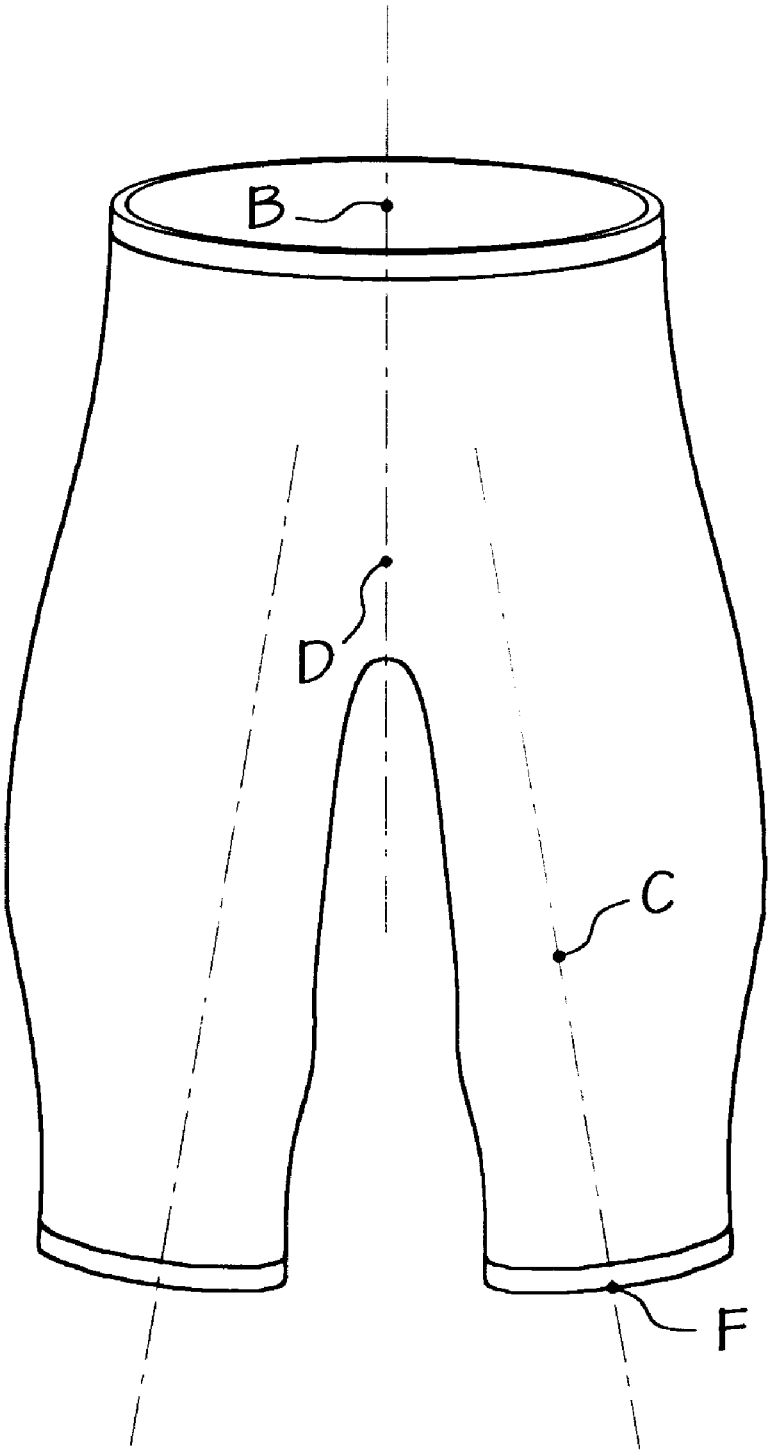

| $R_C$ at | FIG. 11 | FIG. 12 | FIG. 13 | FIG. 14 | FIG. 15 | FIG. 16 | FIG. 17 | FIG. 18 |
|---|---|---|---|---|---|---|---|---|
| Point A about the chest | 0.07 | 0.07 | 0.07 | 0.07 | | | | |
| Point B about the waist | | | | | 0.06 | 0.06 | 0.06 | 0.06 |
| Point C about the thigh | | | | | 0.04 | 0.04 | 0.04 | 0.04 |
| Point D about the hips | | | | | 0.05 | 0.05 | 0.05 | 0.05 |
| Point E about the abdomen | 0.06 | 0.06 | 0.06 | 0.06 | | | | |
| Point F above the knee | | | | | 0.1 | 0.1 | 0.1 | 0.1 |
| Point G above the elbow | 0.08 | 0.08 | 0.08 | | | | | |
| Point H about the bicep muscle | 0.13 | 0.13 | 0.13 | | | | | |
| Point I above the tricep | 0.05 | 0.05 | 0.05 | | | | | |
| Point J below the pectoral muscle | 0.03 | 0.03 | 0.03 | 0.03 | | | | |

Having shown and described the preferred embodiments of the present invention, further adaptions of the body support garments described herein can be accomplished by appropriate modification by one of ordinary skill in the art without departing from the scope of the present invention. Several of such potential modifications have been mentioned, and others will be apparent to those skilled in the art. For example, while the garments of the present invention have been described in the form of pants and vests, a garment enclosing only a portion of the leg or arm (e.g., knee or elbow) can also be made in accordance with the present invention. Also, broad ranges for the physically measurable parameters have been disclosed for the inventive support garments as preferred embodiments of the present invention, yet it is contemplated that the physical parameters of the support garments can be varied to produce other preferred embodiments of improved support garments of the present invention as desired. Thus, the particular embodiments shown and described herein are intended only as preferred exemplary arrangements of the various structures and functions of the present invention, and the scope of the present invention should be considered in terms of the following claims and is understood not be limited to the details of structure and operation shown and described in the specification and drawings.

I claim:

1. A method of manufacturing a garment for supporting an injured body member, comprising the steps of:

(a) measuring a first circumferential length of the injured body member;

(b) forming a generally tubular section from an elastic material, said tubular section having an opening for receiving the injured body member, said material having an inner surface for engaging the body member, by:

(i) sizing said tubular section to provide a predetermined amount of compressing contact with the body member during use, said step of sizing further comprising the steps of selecting a thickness of said material in combination with selecting a first ratio, said first ratio being the difference between a first circumferential length of said tubular section and said first circumferential length of the body member to said first circumferential length of said tubular section, said first ratio being at least about 0.02, said compressing contact supporting the body member in a circumferential direction about the body member; and (ii) selecting a coefficient of friction of said inner surface of at least about 0.4, wherein said compressing contact and said coefficient of friction cooperate to support the body member in a longitudinal direction along the body member during use by resisting rotational motion of the body member.

2. The method of claim 1, wherein said first ratio is between 0.2 and about 0.14.

3. The method of claim 1, wherein said material thickness is further selected to provide a predetermined amount of impact absorption.

4. The method of claim 3, wherein said thickness of said material is at least about 0.1 inches.

5. The method of claim 1, further comprising the step of measuring a second circumferential length of the body member and selecting a second ratio, said second ratio being the difference between a second circumferential length of said tubular section and said second circumferential length of the body member to said second circumferential length of said tubular section, wherein said second ratio is greater than said first ratio and said second ratio is provided adjacent said opening of said tubular section.

6. The method of claim 5, wherein said second ratio is as at least about 0.06.

7. A garment made in accordance with the method of claim 1, wherein said garment is provided in the form of pant having only one leg sleeve.

8. A garment made in accordance with the method of claim 1, wherein said garment is provided in the form of vest having only one arm sleeve.

9. The method of claim 1, wherein said coefficient of friction is at least about 0.5.

10. The method of claim 1, wherein said coefficient of friction is between 0.4 and 1.0.

11. The method of claim 1, wherein said thickness of said material varies over said garment to provide varying amounts of bodily support.

12. The method of claim 1, wherein said tubular section is continuous in the longitudinal direction.

13. A method of supporting a body member, comprising the steps of:

providing a garment having a material thickness and an inner surface for engaging the body member which is supported, substantially all of said inner surface providing a coefficient of friction of between about 0.4 and about 1.0 and a circumferential strain ratio for compressingly contacting the body member, said coefficient of friction and said circumferential strain ratio cooperating to support the body member in a longitudinal direction along the body member and said inner surface supporting the body member in a circumferential direction about the body member;

measuring the circumference of the body member; and selecting said material thickness, said circumferential strain ratio, and said coefficient of friction to provide a predetermined amount of bodily support.

14. The method of claim 13, further comprising the step of providing said garment in the form of a vest having not more than one arm sleeve.

15. The method of claim 14, further comprising the step of providing said arm sleeve to about the elbow of the arm.

16. The method of claim 13, further comprising the step of providing said garment in the form of a pant having not more than one leg sleeve.

17. The method of claim 16, further comprising the step of providing said leg sleeve to about the knee of the leg.

18. A method of manufacturing a garment for supporting an injured body member, comprising the steps of:

(a) measuring a first circumferential length of the injured body member;

(b) forming a generally tubular section from an elastic material, said tubular section having an opening for receiving the injured body member, said material having an inner surface for engaging the body member, by:

(i) sizing said tubular section to provide a predetermined amount of compressing contact with the body member during use, said step of sizing further comprising the steps of selecting a thickness of said material in combination with selecting a first ratio, said first ratio being the difference between a first circumferential length of said tubular section and said first circumferential length of the body member to said first circumferential length of said tubular section, said first ratio being at least about 0.02, said compressing contact supporting the body member in a circumferential direction about the body member;

(ii) selecting a coefficient of friction of said inner surface of at least about 0.4, wherein said compressing contact and said coefficient of friction cooperate to support the body member in a longitudinal direction along the body member during use by resisting rotational motion of the body member;

(iii) selecting said thickness of said material to provide a predetermined amount of impact absorption; and (iv) measuring a second circumferential length of the body member and selecting a second ratio, said second ratio being the difference between a second circumferential length of said tubular section and the second circumferential length of the body member to said second circumferential length of said tubular section, wherein said second ratio is greater than said first ratio and said second ratio is provided adjacent said opening of said tubular section.

19. A garment made in accordance with the method of claim 18.

20. The method of claim 18, wherein said coefficient of friction is at least 0.5.

* * * * *